US007208692B2

(12) United States Patent
Yamaguchi

(10) Patent No.: US 7,208,692 B2
(45) Date of Patent: Apr. 24, 2007

(54) OPERATING SWITCH MECHANISM

(75) Inventor: Masao Yamaguchi, Hachioji (JP)

(73) Assignee: Olympus Corporation, Tokyo (JP)

( * ) Notice: Subject to any disclaimer, the term of this patent is extended or adjusted under 35 U.S.C. 154(b) by 115 days.

(21) Appl. No.: 11/101,907

(22) Filed: Apr. 8, 2005

(65) Prior Publication Data

US 2005/0224332 A1 Oct. 13, 2005

(30) Foreign Application Priority Data

Apr. 13, 2004 (JP) ..... 2004-118255

(51) Int. Cl.
*H01H 15/00* (2006.01)

(52) U.S. Cl. ..... 200/547; 200/548; 200/549; 200/329

(58) Field of Classification Search ..... 200/17 R, 200/43.04, 521, 539, 547–551, 291, 296, 200/329, 338; 341/20, 22, 27; 345/168, 345/169, 184; 235/375; 386/54, 52, 96
See application file for complete search history.

(56) References Cited

U.S. PATENT DOCUMENTS 3,485,966 A * 12/1969 Lutzenberger et al. .... 200/16 D
4,152,565 A * 5/1979 Rose ..... 200/548
4,429,202 A * 1/1984 Tedd et al. ..... 200/324
4,447,689 A * 5/1984 Schiller ..... 200/330
4,531,030 A * 7/1985 Gingerich et al. ..... 200/437
5,862,714 A * 1/1999 Fujimoto ..... 74/527
6,084,192 A * 7/2000 Honma ..... 200/547
6,930,264 B2 * 8/2005 Nagai et al. ..... 200/252

FOREIGN PATENT DOCUMENTS

JP 6-81016 U 11/1994

* cited by examiner

*Primary Examiner*—Michael A. Friedhofer
(74) *Attorney, Agent, or Firm*—Frishauf, Holtz, Goodman & Chick, P.C.

(57) ABSTRACT

An operating switch mechanism in an IC recorder having an operating switch button for slide operation includes an IC recorder main body and an operating unit. The operating unit is attached to the main body by fixing a frame member on the operating unit side with a screw hole of a groove portion. The operating unit includes an operating switch button, a slide plate which switches-on/off switches, and a click spring member which holds a rubber roller. The rubber roller is abutted against a projected portion, a cam surface and an inclined can surface of an inner cam surface portion arranged on the main body side, and the operating switch button is held at the click determining position. The operating switch mechanism is used for an electronic device with high maintenance performance.

5 Claims, 5 Drawing Sheets

OPERATING SWITCH MECHANISM

This application claims benefit of Japanese Application No. 2004-118255 filed in Japan on Apr. 13, 2004, the contents of which are incorporated by this reference.

BACKGROUND OF THE INVENTION

1. Field of the Invention

The present invention relates to an operating switch mechanism for sliding operation which is arranged to an electronic device main body.

2. Description of the Related Art

Japanese Unexamined Utility Model Registration Application Publication No. 6-81016 discloses, as a conventional art, an operating switch mechanism for sliding operation arranged to a compact electronic device, which selectively stops two relatively-transferring members at desired transfer positions by generating transfer resistance at desired positions of the two members. The operating switch mechanism comprises two rubber rollers at symmetric positions on the distal ends of two plate springs which abut against a projected cam of a main body casing.

In general one of conventional operating switch mechanisms, a metallic ball that is energized by a spring is fit and pull-out into/from an engaging hole arranged at the click position to obtain the click force.

SUMMARY OF THE INVENTION

In order to solve the above-mentioned problem, in an operating switch mechanism according to the present invention, operating sound is quiet with high durability and simple maintenance-performance.

According to the present invention, the operating switch mechanism of a data recording and play device comprises: a first member comprising first and second cam surfaces with predetermined shapes; a second member that comprises first and second rollers, is energized by an energizing member toward the first and second cam surfaces, and slides and transfers relatively to the first member along the first and second cam surfaces; and projected portions arranged to the first and second cam surfaces. The first roller is abutted against the projected portion of the first cam surface so as to generate first reactive force in one direction along the slide direction, and the second roller is abutted against the projected portion of the second cam surface so as to generate second reactive force in the direction opposite to the one direction and holds the second member at a predetermined stable position. The operating switch mechanism further comprises: a sliding operating member that slides and transfers the second member by the sliding operation of an operator; and a third member that forms a part of the exterior of the data recording and play device and that can assemble the second member and the sliding operating member. The first member is integrated to the main body of the data recording and play device, and the third member comprises an attaching portion that can be attached/detached to/from the main body of the data recording and play device or the first member in a state in which the second member and the sliding operating member are assembled.

Other features and advantages according to the present invention will be obvious in the following description.

DESCRIPTION OF THE PREFERRED EMBODIMENTS

Hereinbelow, a description is given of an embodiment of the present invention with reference to the drawings.

Figure 1:
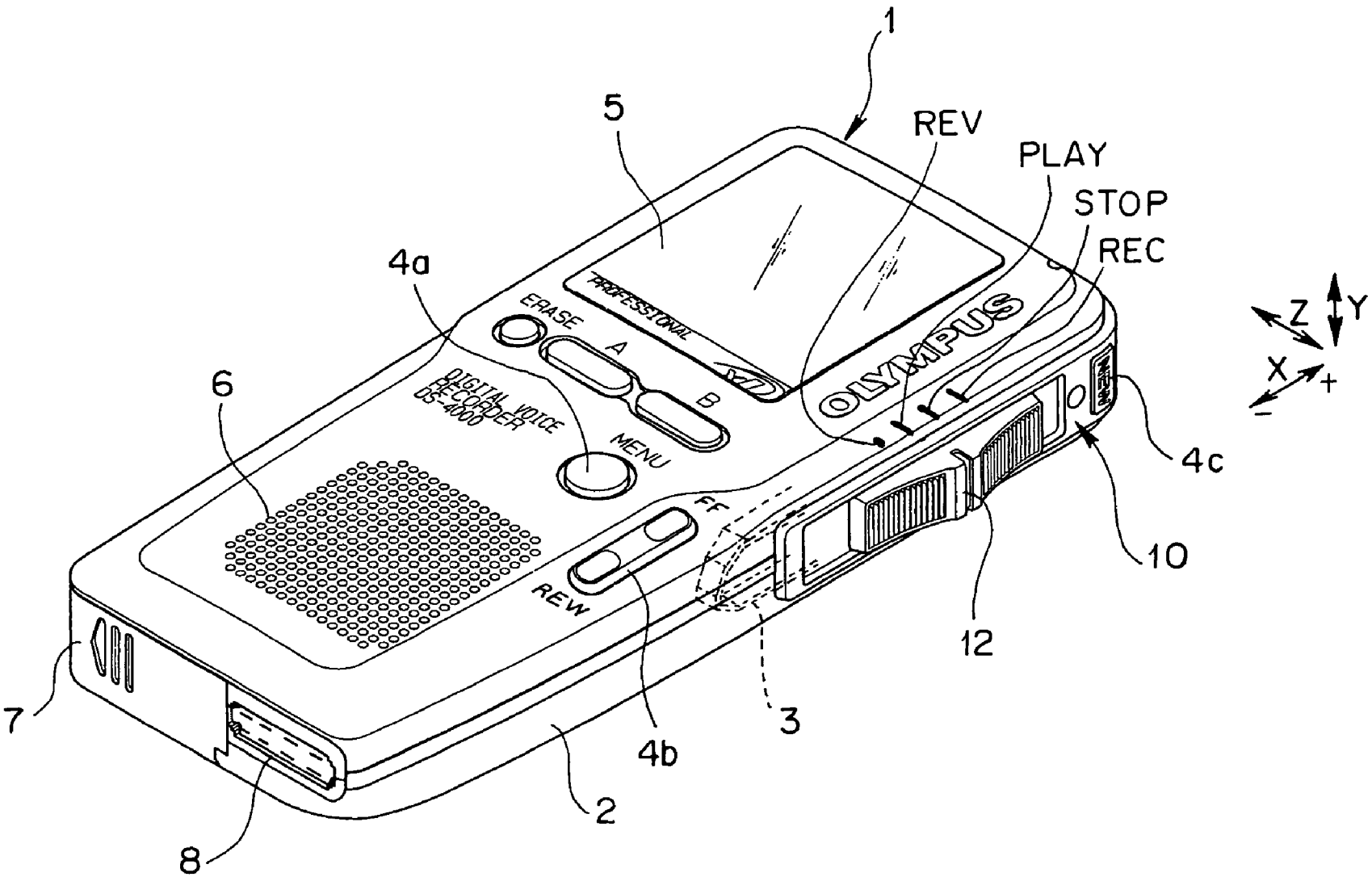
FIG. 1 is a perspective view showing the appearance of an IC recorder serving as a data recording and play device having an operating switch mechanism portion according to an embodiment of the present invention.
Figure 2:
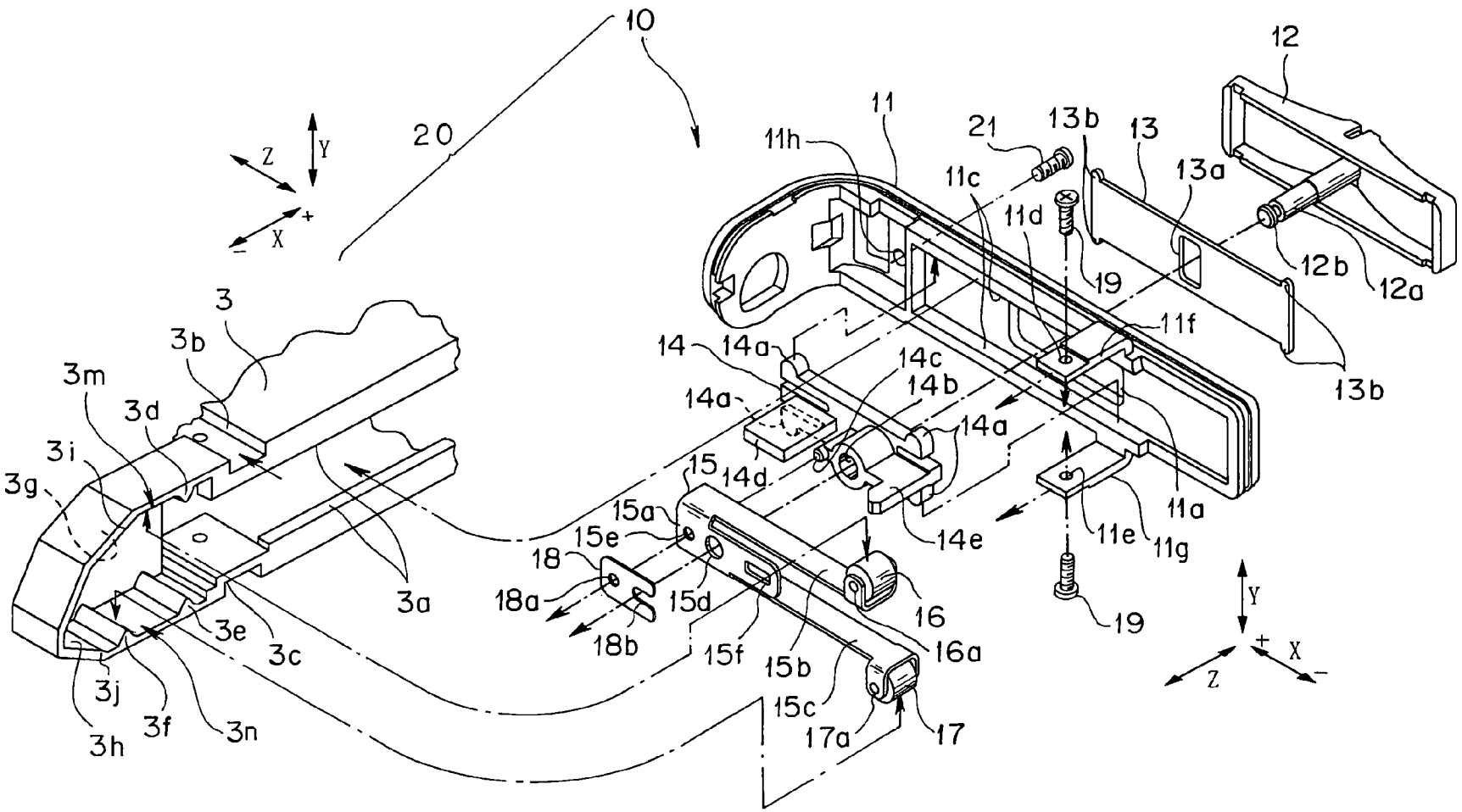
FIG. 2 is an exploded perspective view showing the operating switch mechanism portion incorporated in the IC recorder shown in FIG. 1.
Figure 3:
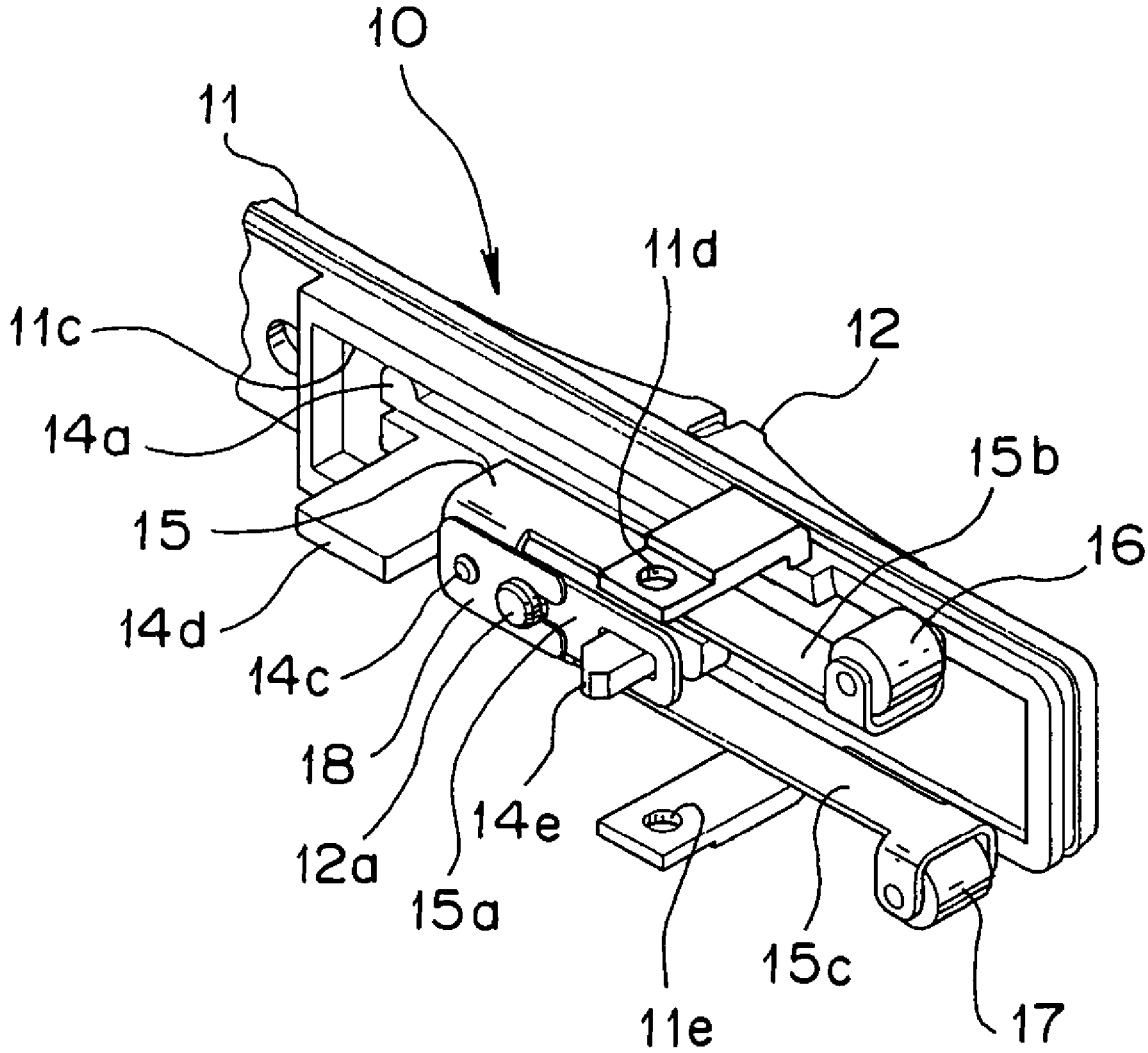
FIG. 3 is a perspective view showing an operating unit forming the operating switch mechanism portion shown in FIG. 2.
Figure 4:
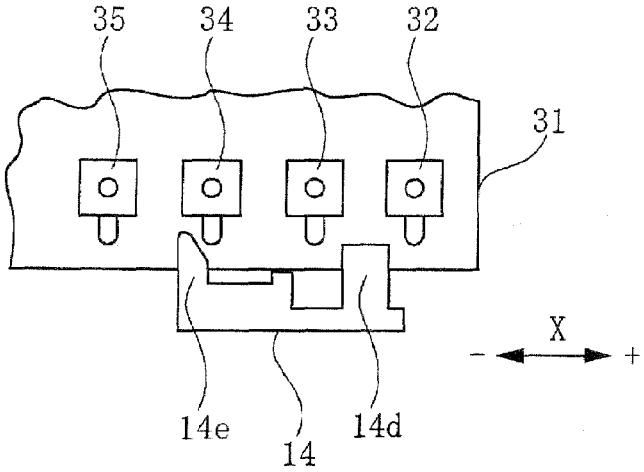
FIG. 4 is a diagram showing the arrangement of operating switches which are switched for on/off operation thereof by the operating switch mechanism portion shown in FIG. 2.

FIG. 1 is a perspective view showing the appearance of an IC recorder serving as a data recording and play device having an operating switch mechanism portion according to the embodiment of the present invention. FIG. 2 is an exploded perspective view showing the operating switch mechanism portion incorporated in the IC recorder shown in FIG. 1. FIG. 3 is a perspective view showing an operating unit forming the operating switch mechanism portion shown in FIG. 2. FIG. 4 is a diagram showing the arrangement of operating switches which are switched for on/off operation thereof by the operating switch mechanism portion shown in FIG. 2.

Hereinbelow, the slide direction of an operating switch button 12, which will be described later, is the X direction. The front side of X direction is on the (+) side, and this side of X direction is on the (−) side. Further, the thickness perpendicular to the X direction is the Y direction, and the direction perpendicular to the X and Y directions is the Z direction.

Referring to FIG. 1, an IC recorder 1 according to the embodiment of the present invention comprises: an IC recorder main body 3, serving as a data recording and play device main body, which supports members such as a recording and play portion; and an exterior cover 2 which covers the IC recorder main body 3. Further, arranged to the outer surface of the exterior cover 2 are operating switch buttons including a menu switch button 4*a*, a feed switch button 4*b*, and a new-file set switch button 4*c*, an LCD display portion 5, a sound producing portion 6, a battery room cover 7, and a USB connector portion 8. Further, an operating switch mechanism portion 20 is arranged on the top on the left side of the exterior cover 2 to instruct the recording, play, and feed operation.

The operating switch button 12 arranged to the operating switch mechanism portion 20 can be slid in the X direction, and can be transferred to click determining positions such as the REC position serving as the recording position, or the PLAY position serving as the play position, from the STOP position serving as the stop position shown in FIG. 1. Further, the operating switch button 12 switches on/off: an REC switch 32 for starting the recording; a switch 34 for stopping the recording; and a PLAY switch 33 for instructing the play operation, which are arranged along the X direction as shown in FIG. 4 at the determining positions, to be clicked and held at the positions. Furthermore, the operating switch button 12 is pressed to the REV position on the (−X) side from the PLAY position to switch on an REV switch 35 for instructing the review and the release of pressing operation returns the operating switch button 12 to the PLAY position. The above-mentioned switches are lever-operating-type switches. The above-mentioned switches are switched on/off by switch operating projections 14*d* and 14*e* connected to the operating switch button 12.

Referring to FIG. 2, the operating switch mechanism portion 20 comprises: an operating unit 10; and an IC recorder main body (hereinafter, abbreviated to a main body) 3, serving as a first member, to which the operating unit 10 is attached and which has a cam portion.

The operating unit 10 is assembled as one unit, and can be attached/detached to/from the main body 3. The operating unit 10 comprises: a frame member 11, serving as a third member, which commonly functions as a part of the exterior of the IC recorder 1; an operating switch button 12, serving as a slide operating member, which is slidably supported by the frame member 11; a sheet member 13, serving as a sliding member, which is inserted between the operating switch button 12 and the frame member 11; a slide plate 14 forming the second member, which is slidably supported by the frame member 11 together with the operating switch button 12; a click spring member 15 forming the second member, which is fixed to the slide plate 14; a rubber roller 16 serving as a first roller and a rubber roller 17 serving as a second roller which form twin rubber rollers and are rotatably supported by the distal ends of a plate spring of the click spring member 15; and a stopper 18 which fixes the click spring member 15 to the slide plate 14.

The IC recorder main body 3 contains a resin, and comprises: an abutting surface 3*a* against which the frame member 11 is abutted; groove portions 3*b* and 3*c* which are arranged to the top and button of the abutting surface 3*a* and which fix the frame member 11; a first cam surface portion 3*m* and a second cam surface portion 3*n* arranged on the top and bottom of the inside; a screw hole and the like.

The first cam surface portion 3*m* comprises on the top: one upper projected portion 3*d* arranged in the X direction; an inclined cam surface 3*g* arranged at the end thereof on the (−X) direction; and a sharply inclined cam surface 3*i* arranged at the end thereof on the (+X) direction of the inclined cam surface 3*g*.

The second cam surface portion 3*n* comprises on the bottom: two lower projected portions 3*e* and 3*f* arranged in the X direction; an inclined cam surface 3*h* arranged at the end thereof on the (−X) side; and a sharply inclined cam surface 3*j* arranged at the end thereof on the (+X) side of the inclined cam surface 3*h*.

The upper projected portion 3*d* and the lower projected portions 3*e* and 3*f* are not completely symmetric projected portions in the X direction. The upper projected portion 3*d* is slightly projected on the (−X) direction, and is concaved on the (−X) direction. The lower projected portions 3*e* and 3*f* are slightly projected on the (−X) direction and are slightly concaved on the (+X) direction. Further, the inclined cam surfaces 3*g* and 3*f* are inclined to narrow the interval therebetween in the (−X) direction, namely, from the start end to the terminal end (refer to FIG. 5).

The frame member 11 comprises: upper and lower fixing projected portions 11*f* and 11*g* which can be fixed on the IC recorder main body 3 side having screw inserting holes lid and 11*e*; an opening 11*a* in which a boss of the operating switch button 12 is inserted; and an inner sliding surface 11*c*, and is entirely plated.

The operating switch button 12 comprises a boss 12*a* projected in the Z direction, and is slidably assembled to the front surface portion of the frame member 11.

The sheet member 13 contains a sheet with preferable sliding performance, and comprises a hole portion 13*a* in which the boss 12*a* is inserted and a projected portion 13*b* for preventing the rattle at the four corner portions. The sheet member 13 is inserted in a sliding surface portion between the operating switch button 12 and the frame member 11 to protect the plated portion of the frame member 11 and smooth the sliding transfer of the operating switch button 12.

The slide plate 14 contains a resin material with high slide-performance (e.g., polyacetal resin), is arranged at the four corners on the frame member side, and is elastically deformable in the Y direction. Further, the slide plate 14 comprises: projected portions 14*a* for preventing the rotating rattle of the operating switch button 12; a boss hole 14*b* into which the boss 12*a* of the operating switch button 12 is fit without any rattle; a rotation-stop pin 14*c* which is arranged on the side of the boss hole 14*b*; and two switch operating projections 14*d* and 14*e* which are arranged in the X direction and are projected in the Z direction.

The click spring member 15 comprises: a center connecting portion 15*a* containing a metallic spring plate member (e.g., a stainless member for spring); and a first plate spring portion 15*b* on the top and a second plate spring portion 15*c* on the bottom, serving as energizing members (elastic springs), which are bent from the top and bottom positions of the center connecting portion 15*a* and are extended in the (−X) direction. The center connecting portion 15*a* comprises: a pin hole 15*e*; a boss hole 15*d*; and a projection inserting hole 15*f*. At the distal end of the first plate spring portion 15*b*, the rubber roller 16 is rotatably supported by a boss 16*a* serving as a rotating boss. Similarly, at the distal end of the second plate spring portion 15*c*, the rubber roller 17 is rotatably supported by a boss 17*a* serving as a rotating boss. Sleeves containing polyacetal resin or the like lie between the rubber roller 16 and the boss 16*a* and between the rubber roller 17 and the boss 17*a* for the purpose of the slide performance for rotation. The rubber rollers 16 and 17 may contain the synthetic resin such as elastomer resin or the like, except for rubber, which is elastic and generates less operating sounds with abrasion resistance.

The boss 16*a* and the boss 17*a* are differently positioned in the X direction. In other words, the rubber rollers 16 and 17 are arranged at positions including no axial core of the boss 17*a* on the plane perpendicular to the slide direction including the axial core of the boss 16*a*. The rubber rollers 16 and 17 are deviated at the positions thereof from each other, thus, when the rubber rollers 16 and 17 are close to each other by the shift thereof, the distal ends of the plate spring portions 15*b* and 15*c* for supporting rubber rollers do not interfere with each other. Thus, the shape reduces the occupied space by the Y direction.

As mentioned above, even when the rubber roller 16 is deviated from the rubber roller 17, the shape of plate spring portions is used so as to make the reactive forces of the rubber rollers 16 and 17 approximately equal to each other. That is, a spring effective length L1 from the supporting point of the plate spring portion 15*b* to the boss 16*a* of the rubber roller 16 is approximately equal to a spring effective length L2 from the supporting point of the plate spring portion 15*c* to the boss 17*a* of the rubber roller 17 (refer to FIG. 4). The spring rigidity of the spring effective length L1 is equal to that of the spring effective length L2, and the amount of flexure of the spring effective length L1 is equal to that of the spring effective length L2. Therefore, when the click spring member 15 is assembled between the first and second cam surface portions 3*m* and 3*n* in the IC recorder main body 3, the rubber roller 16 is abutted against the rubber roller 17 by abutting force (first and second reactive forces) opposite to each other with the approximately same amount of force to the upper projected portion 3*d* and the lower projected portions 3*e* and 3*f*, the cam surfaces 3*i* and 3*j*, or inclined cam surfaces 3*g* and 3*h*. The click force is properly applied to the operating switch button 12 via the click spring member 15, and is held at the click determining position serving as the stable position. Further, the return energizing force is properly applied to the operating switch button 12.

When the operating unit 10 with the above-described structure is assembled as one unit, the boss 12*a* of the operating switch button 12 is inserted in the opening 11*a* of the frame member 11, and is fit into the boss hole 14*b* of the slide plate 14. Then, the slide plate 14 is inserted into the inner surface portion of the frame member 11 in a state that the projected portions 14*a* at the four corners thereof are abutted against the inner sliding surface 11*c* of the frame member 11. The rotation-stop pin 14*c* of the slide plate 14 and the boss 12*a* of the operating switch button 12 are fit and inserted in the pin hole 15*e* and the boss hole 15*d* of the center connecting portion 15*a* of the click spring member 15. Further, the switching operating projection 14*e* of the slide plate 14 is inserted into the projection inserting hole 15*f*. The attachment of the click spring member 15 engages a notch 18*b* of a stopper 18 with the stopper groove 12*b* at the distal end of the boss 12*a*, and the pin hole 18*a* is fit to the pin 14*c* to fix the click spring member 15 to the slide plate 14. In the assembling state, the operating switch button 12, the slide plate 14, and the click spring member 15 are assembled as one unit that is slidably supported by the frame member 11 in the X direction. A shallow slide groove on the front side of the frame member 11 regulates the rotation of the operating switch button 12 that can slidably be transferred in state of one unit. Further, the rotation of the slide plate 14 is regulated by the inner sliding surface 11*c* of the frame member 11.

To assemble the operating unit 10, serving as one unit, to the IC recorder 1, the exterior cover 2 of the IC recorder 1 is detached, then, the fixing projected portions 11*f* and 11*g* of the frame member 11 are inserted in the groove portions 3*b* and 3*c* of the IC recorder main body 3, a screw 19 serving as an attaching member (attaching portion) is screwed to the IC recorder main body 3 by inserting the screw 19 to screw inserting holes lid and lie. Further, a screw 21 serving as an attaching member (attaching portion) is inserted in the screw inserting hole 11*h* and is screwed and fixed to the IC recorder main body 3. The rubber rollers 16 and 17 are bent inside and are inserted into the first cam surface portion 3*m* and second cam surface portion 3*n* having the projected portions 3*d*, 3*e*, and 3*f* of the IC recorder main body 3. The operating switch mechanism portion 20 is assembled to the IC recorder 1 by the attachment of the operating unit 10.

When the operating unit 10 serving as one unit is detached from the IC recorder 1 is detached from the IC recorder main body 3, namely, when the operating unit 10 serving as one unit is detached from the IC recorder 1, in the replacement of the rubber rollers 16 and 17, the detachment operation is simple by the inverse operation of the foregoing.

Figure 5:
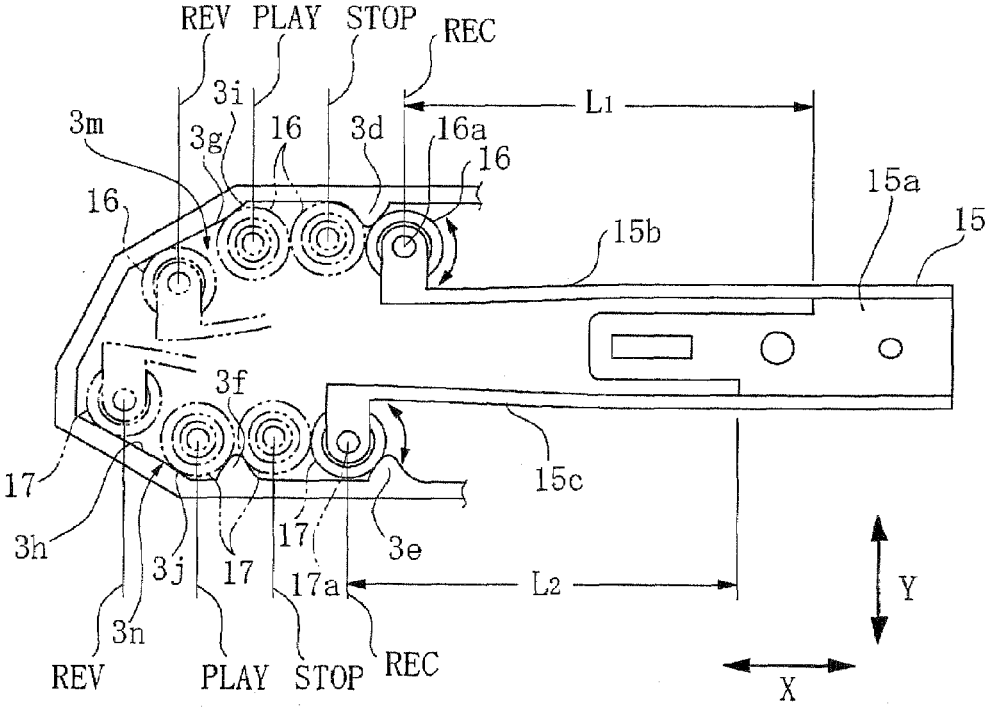
FIG. 5 is a diagram showing a relative transferring positional relationship between a click spring member/rubber roller and an IC recorder main body during the slide transfer from an REC position to an REV position of an operating switch button of the operating switch mechanism portion shown in FIG. 2.
Figure 6A:
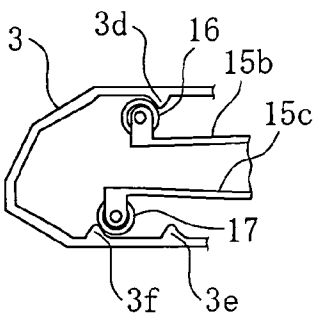
FIG. 6A is an operating status diagram showing a relative transferring positional relationship between the rubber roller and the IC recorder main body when the operating switch button of the operating switch mechanism portion shown in FIG. 2 is at the STOP position.
Figure 6B:
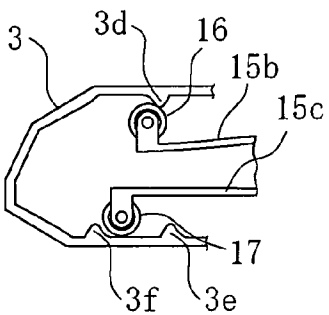
FIG. 6B is an operating status diagram showing one relative transferring positional relationship between the rubber roller and the IC recorder main body during the transfer from the STOP position to the REC position of the operating switch button of the operating switch mechanism portion shown in FIG. 2.
Figure 6C:
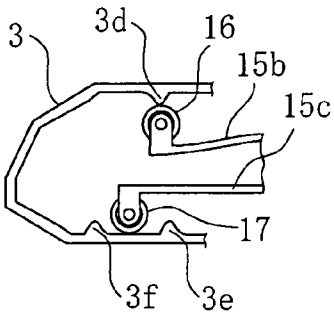
FIG. 6C is an operating status diagram showing another relative transferring positional relationship between the rubber roller and the IC recorder main body during the transfer from the STOP position to the REC position of the operating switch button of the operating switch mechanism portion shown in FIG. 2.
Figure 6D:
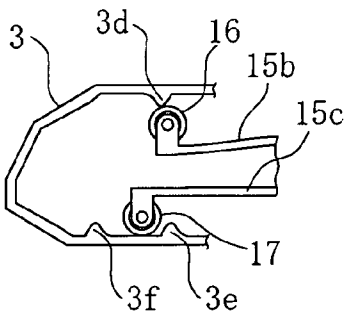
FIG. 6D is an operating status diagram showing a third relative transferring positional relationship between the rubber roller and the IC recorder main body during the transfer from the STOP position to the REC position of the operating switch button of the operating switch mechanism portion shown in FIG. 2.
Figure 6E:
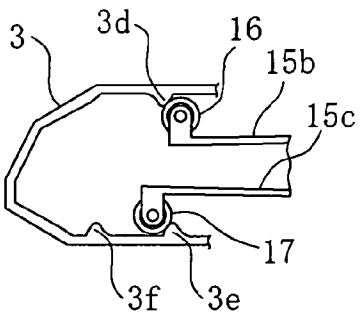
FIG. 6E is an operating status diagram showing the other relative transferring positional relationship between the rubber roller and the IC recorder main body when the operating switch button of the operating switch mechanism portion shown in FIG. 2 reaches the REC position.

Next, a description is given of the operating statuses in the slide operation of the operating switch mechanism portion 20 of the IC recorder 1 with reference to FIGS. 5 to 6E.

FIG. 5 is a diagram showing a relative transferring positional relationship among the click spring member, the rubber roller, and the IC recorder main body during the slide transfer from the REC position to the REV position of the operating switch button of the operating switch mechanism portion. FIGS. 6A to 6E are operating status diagrams showing relative transferring positional relationships between the rubber roller and the IC recorder main body during the transfer from the STOP position to the REV position of the operating switch button of the operating switch mechanism portion.

Referring to FIG. 5, when the operating switch button 12 is at the REC position, the rubber rollers 16 and 17 supported by the click spring member are abutted against the projected portion 3*d* of the IC recorder main body 3 in the (+X) direction and against the projected portion 3*e* of the IC recorder main body 3 in the (−X) direction and are held at the click determining positions. In the state, the rubber roller 16 is abutted against the cam surface expanded of the projected portion 3*d* in the (+X) direction. The rubber roller 17 is abutted against the cam surface expanded of the projected portion 3*e* in the (−X) direction by the similar abutting force and is held. Therefore, the operating switch button 12 is stably held at the click holding force smaller than that at the STOP position, which will be described later, without any click force deviated in the (+X) and (−X) directions.

When the operating switch button 12 is transferred at the STOP position from the REC position, the rubber roller 16 is abutted against the cam surface caved in the (−X) direction of the projected portion 3*d*. The rubber roller 17 is abutted against the cam surface caved in the (+X) direction of the projected portion 3*f* by the similar abutting force and is held. Thus, the operating switch button 12 is stably held at the click determining position without any click force deviated in the (+X) and (−X) direction.

When the operating switch button 12 is transferred at the PLAY position, the rubber roller 16 is abutted against the cam surface 3*i* at the end on the (+X) direction of the inclined surface 3*g*. The rubber roller 17 is abutted against the cam surface 3*j* at the end on the (+X) direction of the inclined cam surface 3*h* and the cam surface expanded in the (−X) direction of the projected portion 3*f* by the similar abutting force and is held. Thus, the operating switch button 12 is held by the click holding force similar to that at the REC position, and is stably held at the click determining position.

Further, when the operating switch button 12 is pressed and is transferred to the REV position from the PLAY position, the rubber rollers 16 and 17 are abutted against the inclined cam surfaces 3*g* and 3*h* by the same force, and are transferred in the (−X) direction. The pressing force is released and then the rubber rollers 16 and 17 return the operating switch button 12 to the PLAY position by the energizing force in the (+X) direction by the inclined cam surfaces 3*g* and 3*h*.

Next, a description is given of the process for transferring the operating switch button 12 from the STOP position to the REC position. At the STOP position, the rubber rollers 16 and 17 are abutted against and are held to the projected portions 3*d* and 3*f* as shown in FIG. 6A. The operating switch button 12 is pressed toward the REC position direction ((+X) direction), the rubber roller 16 is transferred over the projected portion 3*d* as shown in FIGS. 6B to 6D. The rubber roller 17 is transferred on the plane between the projected portions 3*f* and 3*e*. At the REC position, the rubber rollers 16 and 17 are held by the click force to the projected portions 3*d* and 3*e* as shown in FIG. 6E. Therefore, during the transfer operation of the operating switch button 12, the resistance force to be over the projected portion is applied to only the rubber roller 16. The rubber roller 17 is only transferred on the plane and the operating switch button 12 is certainly stopped at the REC position serving as the click determining position. When the operating switch button 12 is transferred from the STOP position to the PLAY position, via the same process, the operating switch button 12 is certainly stopped at the PLAY position serving as the click determining position.

The operating switch mechanism portion 20 in the IC recorder 1 according to the embodiment uses the click mechanism in which the twin rubber rollers 16 and 17 rotatably-supported by the click spring members to apply the click determining force of the operating switch button 12 are abutted against the projected portions containing the synthetic resin on the IC recorder main body 3 side. As compared with the conventional click mechanism using the metallic ball, the operating sound is quiet and the click sense is clear. Further, the abrasion is suppressed against the repeating operation of the operating switch button 12 and the durability is improved.

The rubber rollers 16 and 17 are rotatably supported by the bosses 16*a* and 17*a* via the resin sleeves and therefore the rubber rollers 16 and 17 are smoothly rotated and the durability is improved. Since the rubber rollers 16 and 17 are arranged at the different positions on the slide direction (X direction), the rubber rollers are close to each other on the upper and lower directions (Y direction) without interference of the distal ends of the plate spring portions of the click spring member 15 for supporting the rubber rollers during the slide transfer, and the occupied space by the operating switch mechanism portion 20 in the Y direction is reduced.

Further, when the operating unit of the operating switch mechanism portion 20 must be replaced or needs to be maintained, only the operating unit 10 is easily detached from the IC recorder main body 3 without detachment of the inner members only by removing the exterior cover 2 of the IC recorder 1.

The present invention is not limited to the audio data recording and play device and can be applied to an operating switch mechanism for sliding in another electronic device.

According to the present invention, it is possible to provide an operating switch mechanism of an electronic device with the quiet operating sound, excellent durability, and higher maintenance-performance.

Having described the preferred embodiments of the invention referring to the accompanying drawings, it should be understood that the present invention is not limited to those precise embodiments and various changes and modifications thereof could be made by one skilled in the art without departing from the spirit or scope of the invention as defined in the appended claims.

For example, if some components are deleted from the entire components according to the embodiment, the problem can be solved by the present invention and the advantages according to the present invention are obtained and then the structure obtained by deleting the above components are obtained according to the present invention.

What is claimed is:

1. An operating switch mechanism of a data recording and play device comprising:

a first member comprising first and second cam surfaces with predetermined shapes;

a second member comprising first and second rollers, energized by an energizing member toward the first and second cam surfaces, the second member sliding and transferring relatively to the first member along the first and second cam surfaces; and projected portions arranged to the first and second cam surfaces, wherein the first roller is abutted against the projected portion of the first cam surface so as to generate first reactive force in one direction along the slide direction, and the second roller is abutted against the projected portion of the second cam surface so as to generate second reactive force in the direction opposite to the one direction and holds the second member at a predetermined stable position, the operating switch mechanism further comprising:

a sliding operating member that slides and transfers the second member by the sliding operation of an operator; and a third member that forms a part of the exterior of the data recording and play device and that can assemble the second member and the sliding operating member, wherein the first member is integrated to the main body of the data recording and play device, and the third member comprises an attaching portion that can be attached/detached to/from the main body of the data recording and play device or the first member in a state in which the second member and the sliding operating member are assembled.

2. An operating switch mechanism of a data recording and play device according to claim 1, wherein the first and second rollers are arranged at positions including no axial core of the rotating axis of the second roller on the plane perpendicular to the slide direction including the axial core of the rotating axis of the first roller.

3. An operating switch mechanism of a data recording and play device according to claim 1, wherein the energizing member comprises an elastic spring, and the amount of force for energizing the first roller to the first cam surface is approximately equal to the amount of force for energizing the second roller to the second cam surface.

4. An operating switch mechanism of a data recording and play device according to claim 1, wherein the energizing member comprises a plate spring member, and the length from the supporting point of the plate spring member for holding the first roller to the holding portion of the first roller is approximately equal to the length from the supporting point of the plate spring member for holding the second roller to the holding portion of the second roller.

5. An operating switch mechanism of a data recording and play device according to claim 1, wherein the one ends of the first and second cam surfaces in the same direction comprise inclined surfaces, and the inclined surfaces are formed so as to narrow the interval between the first cam surface and the second cam surface on the terminal end, rather than on the start end of the inclined surface.

* * * * *